US009876321B2

(12) United States Patent
Sasaki

(10) Patent No.: US 9,876,321 B2
(45) Date of Patent: Jan. 23, 2018

(54) CABLE ASSEMBLY, CONNECTOR, AND METHOD FOR MANUFACTURING CABLE ASSEMBLY

(71) Applicant: HOSIDEN CORPORATION, Yao-shi (JP)

(72) Inventor: Daisuke Sasaki, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 15/285,676

(22) Filed: Oct. 5, 2016

(65) Prior Publication Data

US 2017/0110838 A1 Apr. 20, 2017

(30) Foreign Application Priority Data

Oct. 20, 2015 (JP) ..... 2015-206128

(51) Int. Cl.
*H01R 24/38* (2011.01)
*H01B 7/20* (2006.01)
(Continued)

(52) U.S. Cl.
CPC ..... *H01R 24/38* (2013.01); *H01B 7/20* (2013.01); *H01B 11/18* (2013.01); *H01R 4/20* (2013.01);
(Continued)

(58) Field of Classification Search
CPC ..... H01R 9/05; H01R 9/0518; H01R 43/048; H01R 43/042; H01R 4/18; H01R 24/38; H01R 2103/00; H01B 7/20; H01B 11/18
(Continued)

(56) References Cited

U.S. PATENT DOCUMENTS 4,619,496 A * 10/1986 Forney, Jr. ..... H01R 24/40 439/434
4,678,261 A * 7/1987 Mitani ..... H01R 9/0518 439/471
(Continued)

FOREIGN PATENT DOCUMENTS

JP H05-217638 8/1993

OTHER PUBLICATIONS

Machine Translation of JP H05-217638, Aug. 27, 1993, 5 pages.*
European Patent Application No. 16020336.0: Extended European Search Report dated Mar. 10, 2017.

*Primary Examiner* — Tulsidas C Patel
*Assistant Examiner* — Travis Chambers
(74) *Attorney, Agent, or Firm* — Kratz, Quintos & Hanson, LLP

(57) ABSTRACT

A cable assembly including a cable, a metal clamp, and a tuboid metal case. The cable includes a outer insulator and a outer conductor thereinside. The outer conductor includes a protruding portion protruding to one side in the first direction from an end portion of the outer insulator on the one side in the first direction. The clamp holds the protruding portion and includes an end portion on the other side in the first direction. The metal case includes a swaged portion, which houses at least the end portion of the outer insulator and the end portion of the clamp. Swaged from outside, the swaged portion is in pressure contact with and fixed to at least the end portion of the outer insulator and the end portion of the clamp so that the end portion of the outer insulator is elastically deformed and the end portion of the clamp is plastically deformed.

20 Claims, 12 Drawing Sheets

(51) Int. Cl.

| | |
|---|---|
| ***H01B 11/18*** | (2006.01) |
| ***H01R 4/20*** | (2006.01) |
| ***H01R 9/05*** | (2006.01) |
| ***H01R 13/52*** | (2006.01) |
| *H01R 103/00* | (2006.01) |

(52) U.S. Cl.
CPC ..... *H01R 9/0518* (2013.01); *H01R 13/5205* (2013.01); *H01R 2103/00* (2013.01)

(58) Field of Classification Search
USPC ..... 439/578, 584, 585, 877
See application file for complete search history.

(56) References Cited

U.S. PATENT DOCUMENTS 4,684,201 A * 8/1987 Hutter ..... H01R 9/0518 439/585
4,966,560 A * 10/1990 Marzouk ..... H01R 24/58 29/862
5,498,176 A * 3/1996 Hashizawa ..... H01R 9/0518 439/585
8,192,209 B1 * 6/2012 Li ..... H01R 4/64 174/40 CC
8,641,431 B2 * 2/2014 Blasick ..... H01R 9/053 439/578
9,077,090 B2 * 7/2015 Nabeta ..... H01R 4/185
9,093,782 B2 * 7/2015 Wang ..... H01R 13/641
9,472,901 B2 * 10/2016 Wang ..... H01R 13/648
2003/0186583 A1 * 10/2003 Yeh ..... H01R 9/0518 439/585
2004/0018771 A1 * 1/2004 Togashi ..... H01R 9/0518 439/578
2009/0029590 A1 * 1/2009 Sykes ..... H01R 9/0518 439/585
2010/0022126 A1 * 1/2010 Miyashita ..... H01R 4/18 439/585
2010/0055982 A1 * 3/2010 Suzuki ..... H01R 9/032 439/625
2012/0202372 A1 * 8/2012 Hardy ..... H01R 9/0518 439/460
2014/0235104 A1 8/2014 Wang
2017/0040766 A1 * 2/2017 Van Swearingen .. B23K 35/362

* cited by examiner

CABLE ASSEMBLY, CONNECTOR, AND METHOD FOR MANUFACTURING CABLE ASSEMBLY

CROSS-REFERENCE TO RELATED APPLICATIONS

The present application claims priority under 35 U.S.C. §119 of Japanese Patent Application No. 2015-206128 filed on Oct. 20, 2015, the disclosure of which is expressly incorporated by reference herein in its entity.

BACKGROUND OF THE INVENTION

Technical Field

The invention relates to cable assemblies, connectors, and methods for manufacturing the cable assemblies.

Background Art

Unexamined Japanese Patent Application Publication No. 05-217638 discloses a structure of a coaxial cable mounted to a coaxial connector. This conventional structure includes a coaxial connector, a coaxial cable, and a swaged portion.

The coaxial connector has a metal shell, a socket, and an insulative body. The metal shell has a main portion and a tuboid connecting portion. The main portion of the metal shell houses the socket and the body holding the socket.

The coaxial cable has a tuboid outer insulator, a tuboid shield conductor inside the outer insulator, a tuboid inner insulator inside the shield conductor, and an inner conductor inside the inner insulator. The distal portion of the shield conductor protrudes from the outer insulator. The distal portion of the inner insulator protrudes from the distal portion of the shield conductor. The distal portion of the inner conductor protrudes from the distal portion of the inner insulator. The distal portion of the shield conductor fits in the connecting portion of the coaxial connector, and the distal portion of the inner conductor is connected to the socket.

The swaged portion, made of a sheet metal, is wrapped around the outer insulator of the coaxial cable and the connecting portion of the coaxial connector. The swaged portion is swaged from outside to be brought into pressure contact with and fixed to the outer insulator of the coaxial cable and the connecting portion of the coaxial connector.

SUMMARY OF INVENTION

In the wrapping process, the swaged portion may be fixed to the outer insulator of the coaxial cable and the connecting portion of the coaxial connector at a wrong position different from a predetermined position, resulting in deteriorated positioning precision of the swaged portion. Moreover, as the swaged portion is only fixed to the outer insulator of the coaxial cable, the coaxial cable has a low tensile strength.

The present invention is devised in view of the above circumstances and provides a cable assembly and a connector with improved positioning precision of a swaged portion fixed to a cable and with improved tensile strength of the cable. The invention also provides a method for manufacturing such a cable assembly.

A cable assembly of an aspect of the invention includes a cable, a clamp made of metal, and a metal case of tuboid shape. The cable includes an outer insulator of tuboid shape and an outer conductor of tuboid shape. The outer insulator has a first end portion on one side in a first direction. The outer conductor is disposed inside the outer insulator and includes a protruding portion protruding from the first end portion of the outer insulator to the one side in the first direction. The clamp securely holds the protruding portion of the outer conductor and includes a first end portion on the other side in the first direction. The metal case includes a swaged portion of tuboid shape. The swaged portion houses at least the first end portion of the outer insulator and the first end portion of the clamp. The swaged portion is swaged from outside of the swaged portion such as to be in pressure contact with and fixed to at least the first end portion of the outer insulator and the first end portion of the clamp so that the first end portion of the outer insulator is elastically deformed and the first end portion of the clamp is plastically deformed.

The cable assembly of this aspect has at least the following technical features. First, the swaged portion of the metal case is fixed in position relative to the cable with improved precision. This is because the clamp securely holds the protruding portion of the outer conductor; at least the first end portion of the outer insulator and the first end portion of the clamp are received in, and positioned relative to, the swaged portion; and the swaged portion in this state is swaged from outside, so that the swaged portion is fixed to the first end portion of the outer insulator and the first end portion of the clamp. Second, the cable is improved in tensile strength. This is because the swaged portion as swaged is in pressure contact with and fixed to at least the first end portion of the outer insulator and the first end portion of the clamp in such a manner as to at least cause the first end portion of the outer insulator to deform elastically and the first end portion of the clamp to deform plastically.

The metal case may further include a first unswaged portion. The first unswaged portion may be a tuboid end portion of the metal case on the one side in the first direction.

The metal case may further include a second unswaged portion. The second unswaged portion may be a tuboid end portion on the other side in the first direction of the metal case. The second unswaged portion may be larger in inner size or inner diameter than the swaged portion. The outer insulator of the cable may extend through the second unswaged portion with a clearance therebetween. The cable assembly of this aspect is configured to advantageously reduce the possibility that the outer insulator of the cable is brought into contact with the second unswaged portion even when the cable is bent on the other side in the first direction of the metal case. Such reduced contacts reduces load onto the outer insulator of the cable.

The swaged portion may be located between the first unswaged portion and the second unswaged portion of the metal case.

The second unswaged portion may include an inner rim on the other side in the first direction of the second unswaged portion, and a chamfer along the inner rim. In the cable assembly of this aspect, the chamfer is provided along the inner rim to reduce the possibility that the outer insulator of the cable is brought into contact with the inner rim of the second unswaged portion even when the cable is bent on the other side in the first direction of the metal case. Such reduced contacts reduces load onto the outer insulator of the cable.

The second unswaged portion may have a housing recess of ring shape. The housing recess may communicate with a hole of the second unswaged portion and have a bottom. The cable assembly of any aspect described above may further include a first seal being an annular elastic body housed in the housing recess. The outer insulator of the cable may extend through the first seal. The first seal may be in intimate contact with the outer insulator and the bottom of the housing recess. The cable assembly of this aspect has improved resistance to water and dust.

The second unswaged portion may further include a bent portion along an edge on the other side in the first direction of the housing recess. The bent portion may be bent such as to be in contact with the first seal from the other side in the first direction. In the cable assembly of this aspect, the first seal can be readily placed into the housing recess of the second unswaged portion when manufacturing the cable assembly. Particularly, the first seal is placed into the housing recess of the second unswaged portion, and then a portion of the second unswaged portion that corresponds to the bent portion is bent and brought into contact with the first seal from the other side in the first direction. The bent portion is thus formed, and the first seal is housed in the housing recess of the second unswaged portion.

The cable may further include at least one inner insulator of tubular shape and at least one inner conductor. The inner insulator may be disposed inside the outer conductor and include a protruding portion protruding from the protruding portion of the outer conductor to the one side in the first direction. The inner conductor may be disposed inside the inner insulator and include a connecting portion. The connecting portion may protrude from the protruding portion of the inner insulator to the one side in the first direction.

The cable assembly of any aspect described above may further include a body having an insulating property and a terminal. The terminal may be held by the body and connected to the connecting portion of the inner insulator of the cable.

The cable assembly from any one of the above-mentioned aspects may further include a metal shell connected to the clamp. The metal shell may house the body, the terminal, and the connecting portion of the inner conductor.

A connector of an aspect of the invention may include the cable assembly of any aspect described above. The connector may further include a resin case. The resin case may have a housing hole configured to house the cable assembly.

The connector may further include a holding portion generally of U-shape. The resin case may further have a pair of communicating holes communicating with the housing hole on one and the other sides, respectively, in a second direction of the housing hole. The second direction may be orthogonal to the first direction. The holding portion may be fixed to the resin case and may have a pair of holding arms. The holding arms may be disposed inside the associated communicating holes and securely hold the first unswaged portion of the metal case. In the connector of this aspect, the cable assembly can be readily fixed in position inside the housing hole of the resin case.

The connector of any aspect described above may include a second seal being an annular elastic body. At least one of the first unswaged portion and the second unswaged portion of the metal case of the cable assembly may extend inside the second seal. The second seal may be in intimate contact with the at least one unswaged portion and a wall of the housing hole of the resin case.

A method for manufacturing a cable assembly from an aspect of the invention includes preparing a cable including an outer insulator and an outer conductor, the outer conductor including a protruding portion protruding to one side in a first direction from a first end portion of the outer insulator; preparing a clamp made of metal; fitting the clamp over the protruding portion of the outer conductor; preparing a metal case of tubular shape; inserting into the metal case at least the clamp, which fits over the protruding portion of the outer conductor of the cable, and the first end portion of the outer insulator of the cable; and swaging at least a portion of the metal case from outside. The swaging of the metal case includes bringing the at least a portion of the metal case into pressure contact with at least the first end portion of the outer insulator and a first end portion of the clamp on the other side in the first direction so that the at least a portion is fixed to the first end portion of the outer insulator and the first end portion of the clamp. The bringing of the metal case into pressure contact at least causes the first end portion of the outer insulator to deform elastically and the first end portion of the clamp to deform plastically.

The fitting of the clamp may include wrapping the clamp, which may be a sheet metal, around the protruding portion of the outer conductor. Alternatively, the fitting of the clamp may include inserting the protruding portion of the outer conductor into the clamp, which may be a tubular metal.

Figure 1A:
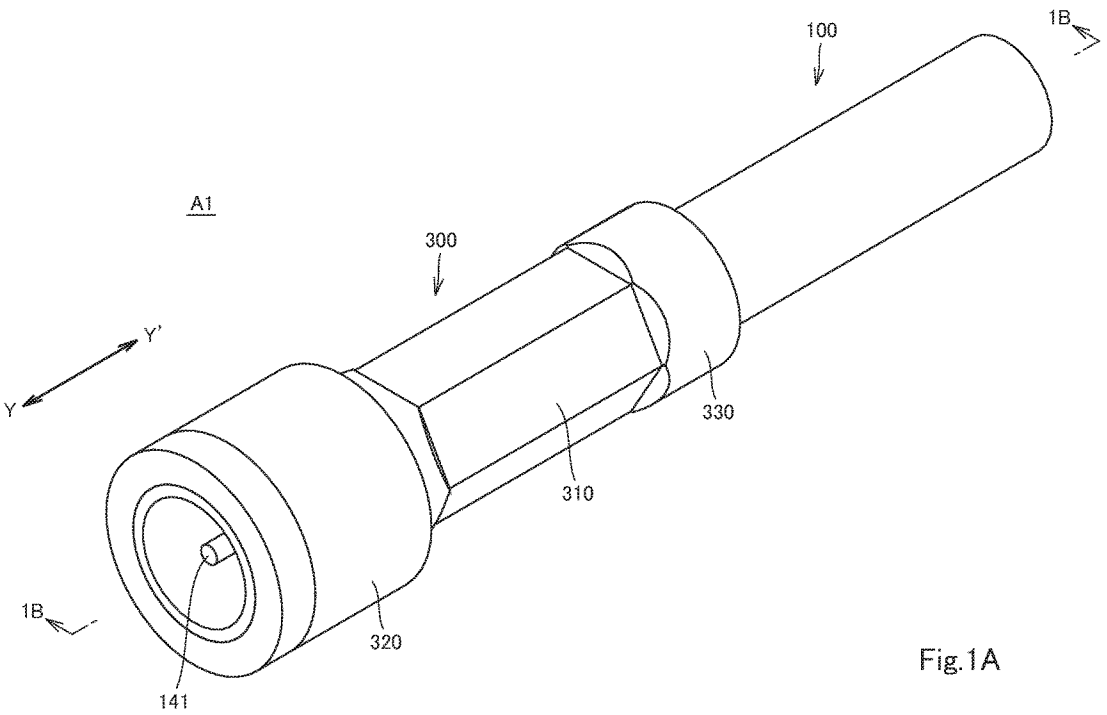
FIG. 1A is a front, top, right side perspective view of a cable assembly of a first embodiment of the invention.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the cable assembly, the connector, and their constituent parts as depicted in the drawings. No limitation is intended by use of these terms, either in use of the invention, during its manufacture, shipment, custody, or sale, or during assembly.

DESCRIPTION OF EMBODIMENTS

Embodiments of the invention will be described below.

A cable assembly A1 (hereinafter also referred to as assembly A1) according to some embodiments of the invention will now be described with reference to FIGS. 1A to 2B.

FIGS. 1A to 2B show an assembly A1 according to one of the embodiments (hereinafter referred to as the first embodiment). The assembly A1 includes a cable 100, a clamp 200 made of metal, and a metal case 300 of tuboid shape. FIG. 1A and FIG. 1B indicate the Y-Y' direction, which corresponds to the longitudinal direction of the metal case 300 and the first direction in the claim. In the Y-Y' direction, the Y direction corresponds to one side in the first direction, and the Y' direction corresponds to the other side in the first direction.

The cable 100 includes an outer insulator 110 of tuboid shape, an outer conductor 120 of tuboid shape, at least one inner insulator 130 of tuboid shape, and at least one inner conductor 140. The outer insulator 110 may preferably be the outer sheath of the cable 100. The outer insulator 110 has a first end portion 111, which is an end portion on the Y-direction side. The outer conductor 120 is disposed inside the outer insulator 110. The outer conductor 120 has a protruding portion 121 protruding in the Y direction from the first end portion 111 of the outer insulator 110. The protruding portion 121 is an end portion on the Y-direction side of the outer conductor 120. The inner insulator 130 is disposed inside the outer conductor 120. The inner insulator 130 includes a protruding portion 131 protruding in the Y direction from the protruding portion 121 of the outer conductor 120. The protruding portion 131 is an end portion on the Y-direction side of the inner insulator 130. The inner conductor 140 is disposed inside the inner insulator 130. The inner conductor 140 includes a connecting portion 141, which is an end portion of the inner conductor 140 and protrudes in the Y direction from the protruding portion 131.

The cable 100 may include a plurality of the inner insulators 130 disposed inside the outer conductor 120. The cable 100 may include a plurality of the inner conductors 140 disposed inside the respective inner insulators 130.

In the embodiment shown in FIG. 1A to FIG. 2B, the cable 100 is a coaxial cable with a single inner insulator 130 and a single inner conductor 140. The outer insulator 110, the outer conductor 120, and the inner insulator 130 are each of circular tuboid shape.

The clamp 200 securely holds the protruding portion 121 of the outer conductor 120 of the cable 100. More particularly, the clamp 200 may be made of a sheet metal and may be wrapped around and securely hold the protruding portion 121 of the outer conductor 120. The wrapped clamp 200 may have a tubular shape or may have a cross-section generally of arcuate shape, C-shape, or U-shape. Alternatively, the clamp 200 may be a metal tube having a cross-section of circular, polygonal, or other shape and may fit over and securely hold the protruding portion 121 of the outer conductor 120. In the embodiment shown in FIG. 1B and FIG. 2B, the clamp 200 is a sheet metal curved into a tubular shape and wrapped around the protruding portion 121.

The clamp 200 is electrically connected to the outer conductor 120 by holding the protruding portion 121 of the outer conductor 120. The clamp 200 includes a first end portion 210 being an end portion on the Y'-direction side, a second end portion 220 being an end portion on the Y-direction side, and a middle portion therebetween. The first end portion 210 is located near the first end portion 111 of the outer insulator 110 of the cable 100. In other words, the first end portion 210 and the first end portion 111 are disposed next to each other along the Y-Y' direction.

The clamp 200 may further include at least one engaging protrusion 230. The or each engaging protrusion 230 is an annular, arcuate, rectangular, or circular protrusion protruding inwardly of the clamp 200. In the embodiment shown in FIG. 2A and FIG. 2B, the clamp 200 includes two engaging protrusions 230 spaced along the Y-Y' direction. The engaging protrusions 230 are stamped from the outer circumferential face side of the clamp 200 to protrude inwardly of the clamp 200 to form an arcuate curve along the circumference of the clamp 200. Accordingly, the outside of the engaging protrusions 230 form recesses. The engaging protrusions 230 engage with the outer conductor 120 of the cable 100. This engagement improves the tensile strength in the Y-Y' direction of the clamp 200 with respect to the outer conductor 120 of the cable 100.

The metal case 300 is a tube extending in the Y-Y' direction having a cross-section of circular, polygonal, or other shape. The metal case 300 includes a swaged portion 310 of tuboid shape. The swaged portion 310 may be a portion in the Y-Y' direction of the metal case 300, e.g. an end portion on the Y-direction side, an end portion on the Y'-direction side, or a middle portion between the end portion on the Y-direction side and the end portion on the Y'-direction side. Alternatively, the swaged portion 310 may be the entire metal case 300*a*. In the embodiment shown in FIG. 1A to FIG. 2B, the swaged portion 310 is a middle portion of the metal case 300.

The swaged portion 310 may preferably house at least the first end portion 111 of the outer insulator 110 of the cable 100 and the first end portion 210 of the clamp 200. Alternatively, the swaged portion 310 may house the first end portion 111 of the outer insulator 110 of the cable 100, the first end portion 210 of the clamp 200, and the middle portion of the clamp 200. Alternatively, the swaged portion 310 may house the first end portion 111 of the outer insulator 110 of the cable 100 and the entire clamp 200. In the embodiment shown in FIG. 1B, the swaged portion 310 houses the first end portion 111 of the outer insulator 110 of the cable 100, and a portion (including the first end portion 210 and the middle portion) of the clamp 200 other than the second portion 220.

Figure 1B:
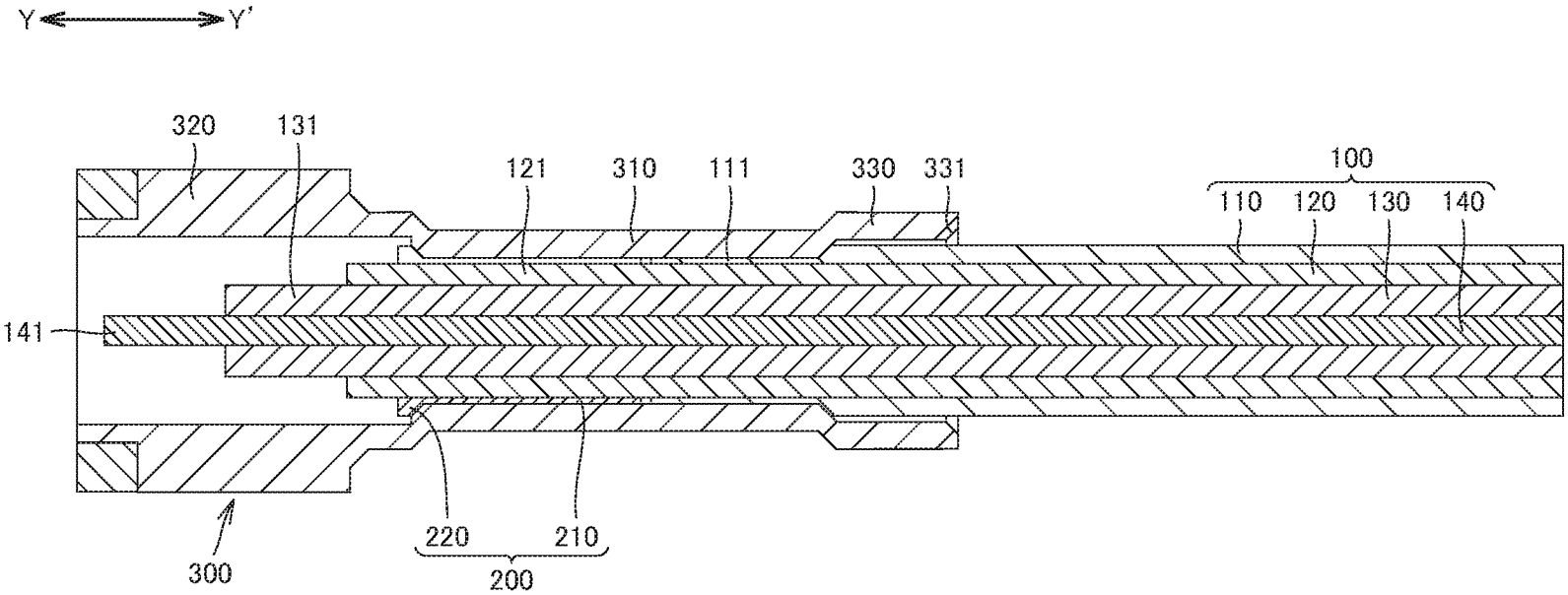
FIG. 1B is a sectional view of the cable assembly, taken along the line 1B-1B in FIG. 1A.
Figure 2A:
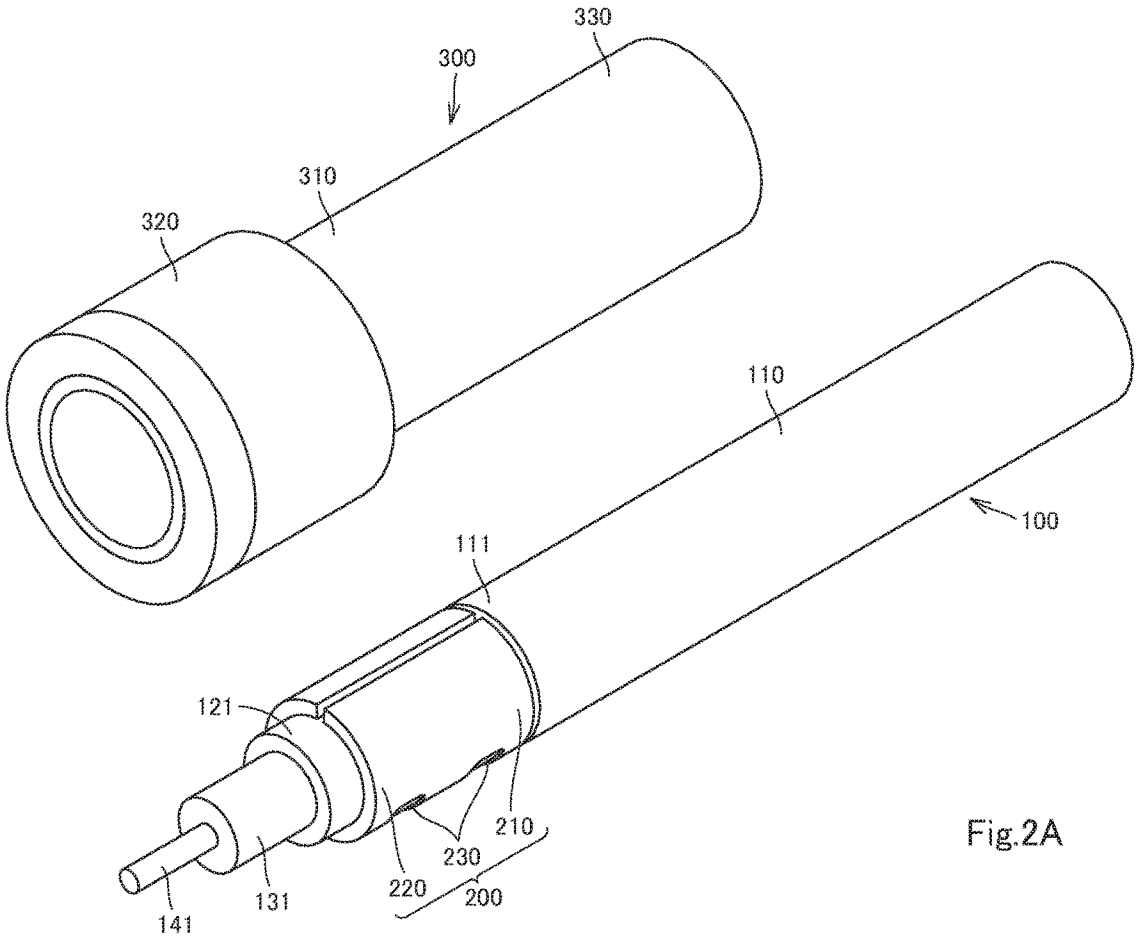
FIG. 2A is a front, top, right side perspective view of a cable, a clamp, and a metal case of the cable assembly in a state before inserting the cable and the clamp into the metal case.
Figure 2B:
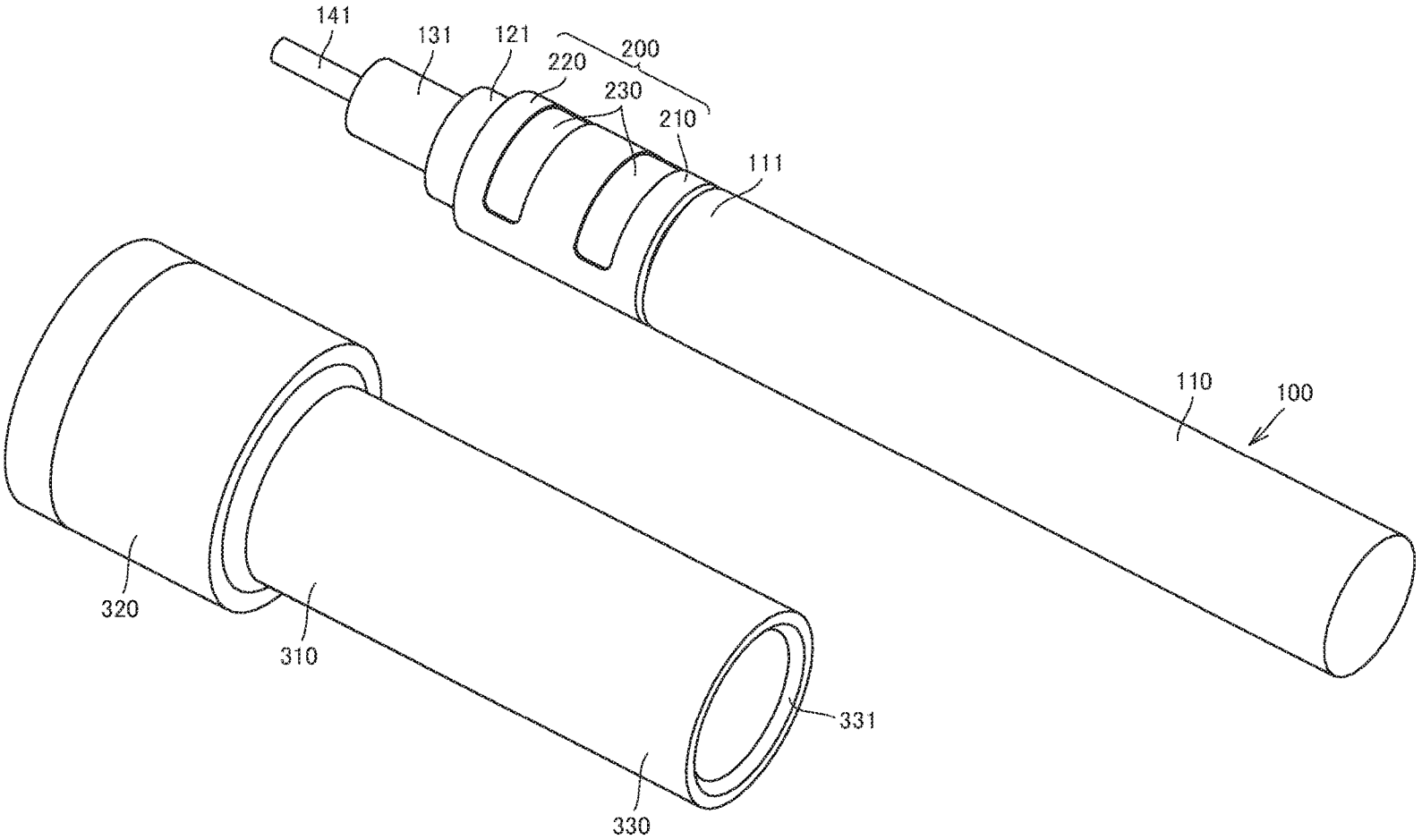
FIG. 2B is a rear, bottom, left side perspective view of the cable, the clamp, and the metal case of the cable assembly in a state before inserting the cable and the clamp into the metal case.

The swaged portion 310 is swaged from the outside of the swaged portion 310 toward the outer insulator 110 and the clamp 200. As swaged, the swaged portion 310 is in pressure contact with and fixed to at least the first end portion 111 of the outer insulator 110 of the cable 100 and the first end portion 210 of the clamp 200. The pressure onto the swaged portion 310 causes elastic deformation of at least the first end portion 111 of the outer insulator 110 of the cable 100 and plastic deformation (buckling) of the first end portion 210 of the clamp 200 toward the outer conductor 120. The swaged portion 310 may be in pressure contact with and fixed to the first end portion 111 of the outer insulator 110 of the cable 100, the first end portion 210 of the clamp 200, and the middle portion of the clamp 200. In this case, the pressure onto the swaged portion 310 causes elastic deformation of the first end portion 111 of the outer insulator 110 and plastic deformation (buckling) of the first end portion 210 and the middle portion of the clamp 200. Alternatively, the swaged portion 310 may be in pressure contact with and fixed to the first end portion 111 of the outer insulator 110 of the cable 100 and the entire clamp 200. In this case, the pressure onto the swaged portion 310 causes elastic deformation of the first end portion 111 of the outer insulator 110 and plastic deformation (buckling) of the entire clamp 200. In the embodiment shown in FIG. 1B, the swaged portion 310 is in pressure contact with and fixed to the first end portion 111 of the outer insulator 110 of the cable 100 and a portion of the clamp 200 other than the second portion 220, and the pressure onto the swaged portion 310 causes elastic deformation of the first end portion 111 of the outer insulator 110 of the cable 100 and plastic deformation of the portion of the clamp 200 other than the second portion 220. The metal case 300 is electrically connected to the outer conductor 120 of the cable 100 via the clamp 200. It should be appreciated that FIG. 1A and FIG. 1B illustrate the swaged portion 310 as swaged, and that FIG. 2A and FIG. 2B illustrate the swaged portion 310 as unswaged. Hereinafter, the portion of the clamp 200 that is fixed to the swaged portion 310 will also be referred to as a fixed portion of the clamp 200.

The metal case 300 may further include a first unswaged portion 320, which is a tuboid end portion on the Y-direction side of the metal case 300. The inside of the first unswaged portion 320 communicates with the inside of the swaged portion 310. The first unswaged portion 320 may have a larger inner size or inner diameter than that of the swaged portion 310, may have a smaller inner size or inner diameter than that of the swaged portion 310, or may have the same inner size or inner diameter as that of the swaged portion 310. In the embodiment shown in FIG. 1A to FIG. 2B, the first unswaged portion 320 has a larger inner size or inner diameter than that of the swaged portion 310.

If the fixed portion of the clamp 200 is a portion of the clamp 200 as described above, the first unswaged portion 320 may house a portion of the clamp 200 on the Y-direction side relative to the fixed portion of the clamp 200 and the protruding portion 131 of the inner insulator 130 of the cable 100, or may house the portion of the clamp 200 on the Y-direction side relative the fixed portion of the clamp 200, the protruding portion 131 of the inner insulator 130, and the connecting portion 141 of the inner conductor 140 of the cable 100. If the fixed portion of the clamp 200 is the entire clamp 200 as described above, the first unswaged portion 320 may house the protruding portion 131 of the inner insulator 130 of the cable 100, or may house the protruding portion 131 of the inner insulator 130 and the connecting portion 141 of the inner conductor 140 of the cable 100. In the embodiment shown in FIG. 1B, the first unswaged portion 320 houses in a non-contacting manner the portion of the clamp 200 on the Y-direction side relative to the fixed portion of the clamp 200, the protruding portion 131 of the inner insulator 130 of the cable 100, and the connecting portion 141 of the inner conductor 140 of the cable 100. In another embodiment, the first unswaged portion 320 houses in a non-contacting manner the protruding portion 131 of the inner insulator 130 and the connecting portion 141 of the inner conductor 140 of the cable 100 only.

The metal case 300 may further include a second unswaged portion 330. The second unswaged portion 330 is an end portion on the Y'-direction side of the metal case 300. The inside (hole) of the second unswaged portion 330 communicates with the inside (hole) of the swaged portion 310. The second unswaged portion 330 has a larger inner size or inner diameter than the swaged portion 310. Through the second unswaged portion 330 extends the outer insulator 110 of the cable 100 with a clearance therebetween. In other words, a portion of the outer insulator 110 on the Y'-direction side with respect to the first end portion 111 of the outer insulator 110 is disposed in midair inside the second unswaged portion 330.

The second unswaged portion 330 may include a hole, an inner rim on the Y'-direction side, and a chamfer 331. The hole extends in the Y-Y' direction through the second unswaged portion 330. The inner rim is a circular ring-shaped or polygonal ring-shaped inner part on the Y'-direction side of the second unswaged portion 330. The chamfer 331, which is an inclined face along the inner rim of the second unswaged portion 330, is inclined in the Y-direction and toward the radial center of the second unswaged portion 330.

The assembly A1 may further include a body, not shown, made of an insulating material, such as a plastic material. The body may include a connecting portion and a support portion. The connecting portion has a connecting hole, a tongue, or a tubular portion, at the Y-direction end of the body. The support portion has a support hole or a platform at the Y'-direction end of the body.

The assembly A1 may further include at least one terminal not shown. The terminal is held in the body. Specifically, the terminal may be insert-molded in the body or held in a hole of the body. The terminal includes a contact portion and a tail. The contact portion is disposed inside the connecting hole or tubular portion of the connecting portion or is exposed out of the tongue of the connecting portion. The tail is disposed inside the support hole of the support portion or on the platform of the support portion. The tail is connected to the connecting portion 141 of the inner conductor 140 of the cable 100. If the cable 100 includes a plurality of inner conductors 140 and a plurality of inner insulators 130, a plurality of terminals is accordingly provided. In this case, the support portion of the body has a plurality of support holes or one or more platforms, and the terminals are held in the body such that the tails of the terminals are disposed inside the respective support holes or on the platform or respective platforms of the support portion. The tails of the contacts are connected to the respective connecting portions 141 of the inner conductors 140.

The body and the at least one terminal may be at least partially disposed inside the first unswaged portion 320. If a plurality of terminals is provided, the body and the terminals may be at least partially disposed inside the first unswaged portion 320. In either case, the first unswaged portion 320 may function as a shield case.

The assembly A1 described above may be manufactured in the following steps. First, the cable 100 is prepared to have the following configuration. The protruding portion 121 of the outer conductor 120 protrudes in the Y direction from the first end portion 111 of the outer insulator 110. The protruding portion 131 of the at least one inner insulator 130 protrudes in the Y direction from the protruding portion 121 of the outer conductor 120. The connecting portion 141 of the at least one inner conductor 140 protrudes in the Y direction from the protruding portion 131 of the inner insulator 130.

The clamp 200 is prepared. The clamp 200 is fitted over the protruding portion 121 of the outer conductor 120 of the cable 100. More particularly, if the clamp 200 is made of a sheet metal, the fitting of the clamp 200 may preferably include wrapping the clamp 200 around the protruding portion 121 of the outer conductor 120 to curve the clamp 200 into a tubular shape or into a shape having a cross-section generally of arcuate, C-, or U-shape. If the clamp 200 is a metal tube, the fitting of the clamp 200 may include inserting or fitting the protruding portion 121 of the outer conductor 120 into the clamp 200.

The metal case 300 is also prepared to have the following configuration. 1) At least a portion of the metal case 300, which corresponds to the swaged portion 310, is not swaged. 2) The metal case 300 entirely has a larger inner size or inner diameter than the outer size or outer diameter of the cable 100 and than the outer size or outer diameter of the clamp 200 fitting over the protruding portion 121 of the outer conductor 120 of the cable 100.

Thereafter, into the metal case 300 inserted are the Y-direction end portion of the cable 100 and the clamp 200 as fitting over the protruding portion 121. This inserting step includes disposing into at least a portion of the metal case 300 the clamp 200 as fitting over the protruding portion 121 of the outer conductor 120 of the cable 100 and the first end portion 111 of the outer insulator 110 of the cable 100. If the metal case 300 includes the first unswaged portion 320, the inserting step may include disposing into the first unswaged portion 320 the protruding portion 131 of the inner insulator 130 of the cable 100, and or include disposing into the first unswaged portion 320 the protruding portion 131 of the inner insulator 130 and the connecting portion 141 of the inner conductor 140 of the cable 100.

If the assembly A1 includes the body and the at least one terminal and the metal case 300 includes the first unswaged portion 320, prior to the inserting step, the connecting portion 141 of the inner conductor 140 of the cable 100 is connected to the terminal held in the body. The inserting step may include disposing into the first unswaged portion 320 the body, the terminal, and the connecting portion 141 of the inner conductor 140.

If the metal case 300 includes the second unswaged portion 330, the inserting step includes disposing into the second unswaged portion 330 a portion of the cable 100 on the Y'-direction side relative to the first end portion 111 of the outer insulator 110. If the metal case 300 includes the first unswaged portion 320 and/or the second unswaged portion 330, the first unswaged portion 320 and/or the second unswaged portion 330 may preferably be preformed in the prepared metal case 300.

Then, at least a portion of the metal case 300 is swaged from the outside. The at least a portion of the metal case 300 may be a Y-direction end portion of the metal case 300, a Y'-direction end portion of the metal case 300, and/or a middle portion of the metal case 300, or may be the entire metal case 300. The step of swaging the metal case 300 may includes one of the following actions (1) to (4) but not limited thereto:

(1) bringing the at least a portion of the metal case 300 into pressure contact with the first end portion 111 of the outer insulator 110 of the cable 100 and the first end portion 210 of the clamp 200 so that the at least a portion of the metal case 300 is fixed to the first end portion 111 and the first end portion 210;

(2) bringing the at least a portion of the metal case 300 into pressure contact with the first end portion 111 of the outer insulator 110 of the cable 100, the first end portion 210 of the clamp 200, and the middle portion of the clamp 200 so that the at least a portion of the metal case 300 is fixed to the first end portion 111, the first end portion 210, and the middle portion of the clamp 200;

(3) bringing the at least a portion of the metal case 300 into pressure contact with the first end portion 111 of the outer insulator 110 of the cable 100, and with a portion of the clamp 200 other than the second portion 220 so that the at least a portion of the metal case 300 is fixed to the first end portion 111 and the portion of the clamp 200 other than the second portion 220; or (4) bringing the at least a portion of the metal case 300 into pressure contact with the first end portion 111 of the outer insulator 110 of the cable 100 and the entire clamp 200 so that the at least a portion of the metal case 300 is fixed to the first end portion 111 and the entire clamp 200.

These steps (1) to (4) may respectively include the following actions (1a) to (4b), but not limited thereto:

(1a) bringing the at least a portion of the metal case 300 into pressure contact includes elastically deforming the first end portion 111 of the outer insulator 110, and plastically deforming the first end portion 210 of the clamp 200;

(2a) bringing the at least a portion of the metal case 300 into pressure contact includes elastically deforming the first end portion 111 of the outer insulator 110, and plastically deforming the first end portion 210 and the middle portion of the clamp 200;

(3a) bringing the at least a portion of the metal case 300 into pressure contact includes elastically deforming the first end portion 111 of the outer insulator 110, and plastically deforming the portion of the clamp 200 other than the second portion 220; and (4a) bringing the at least a portion of the metal case 300 into pressure contact includes elastically deforming the first end portion 111 of the outer insulator 110, and plastically deforming the entire clamp 200.

The assembly A1 is thus manufactured.

The assembly A1 has at least the following technical features. First, the swaged portion 310 of the metal case 300 is fixed in position relative to the cable 100 with improved precision. This is because the clamp 200 securely holds the protruding portion 121 of the outer conductor 120; at least the first end portion 111 of the outer insulator 110 of the cable 100 and the first end portion 210 of the clamp 200 are received in, and positioned relative to, the at least a portion of the metal case 300; the at least a portion of the metal case 300 in this state is swaged from outside, so that the swaged portion (the swaged portion 310) is fixed to at least the first end portion 111 of the outer insulator 110 and the first end portion 210 of the clamp 200.

Second, the cable 100 is improved in tensile strength. This is because the swaged portion 310 is in pressure contact with and fixed to at least the first end portion 111 of the outer insulator 110 and the first end portion 210 of the clamp 200 in such a manner as to at least cause the first end portion 111 of the outer insulator 110 to deform elastically and the first end portion 210 of the clamp 200 deform plastically.

Third, it is possible to minimize the swaged portion 310 in length along the Y-Y' direction (swaging area (buckling area) along the Y-Y' direction). This is because the swaged portion 310 is fixed to at least the first end portion 111 of the outer insulator 110 and the first end portion 210 of the clamp 200 as described above, resulting in increased tensile strength of the cable 100.

Fourth, the outer insulator 110 of the cable 100 is relatively unlikely to be subjected to load caused when the cable 100 is bent at a portion on the Y'-direction side of the metal case 300. Generally, when this portion of the cable is bent, contact between the outer insulator of the cable and the metal case imposes load on the outer insulator. However, the assembly A1 is configured such that the second unswaged portion 330 of the metal case 300 houses the outer insulator 110 of the cable 100 with a clearance therebetween. Moreover, the chamfer 331 is provided along the inner rim on the Y'-direction side of the second unswaged portion 330. This configuration reduces the possibility that the outer insulator 110 of the cable 100 is brought into contact with the second unswaged portion 330 of the metal case 300 and/or the inner rim of the second unswaged portion 330 even when the cable 100 is bent at a portion on the Y'-direction side of the metal case 300. Such reduced contacts reduces load onto the outer insulator 110 of the cable 100.

A connector including the assembly A1 may be configured as follows. The connector may further include a resin case, not shown, having a housing hole to house the assembly A1. If the assembly A1 does not include any body or any terminal, the connecting portion 141 of the inner conductor 140 of the cable 100 of the assembly A1 may be connectable to a terminal of a mating connector. If the assembly A1 includes the body and the terminal, the terminal of the assembly A1 may be connectable to a terminal of a mating connector. The connector described above has at least the same technical features as those of the assembly A1.

Figure 3A:
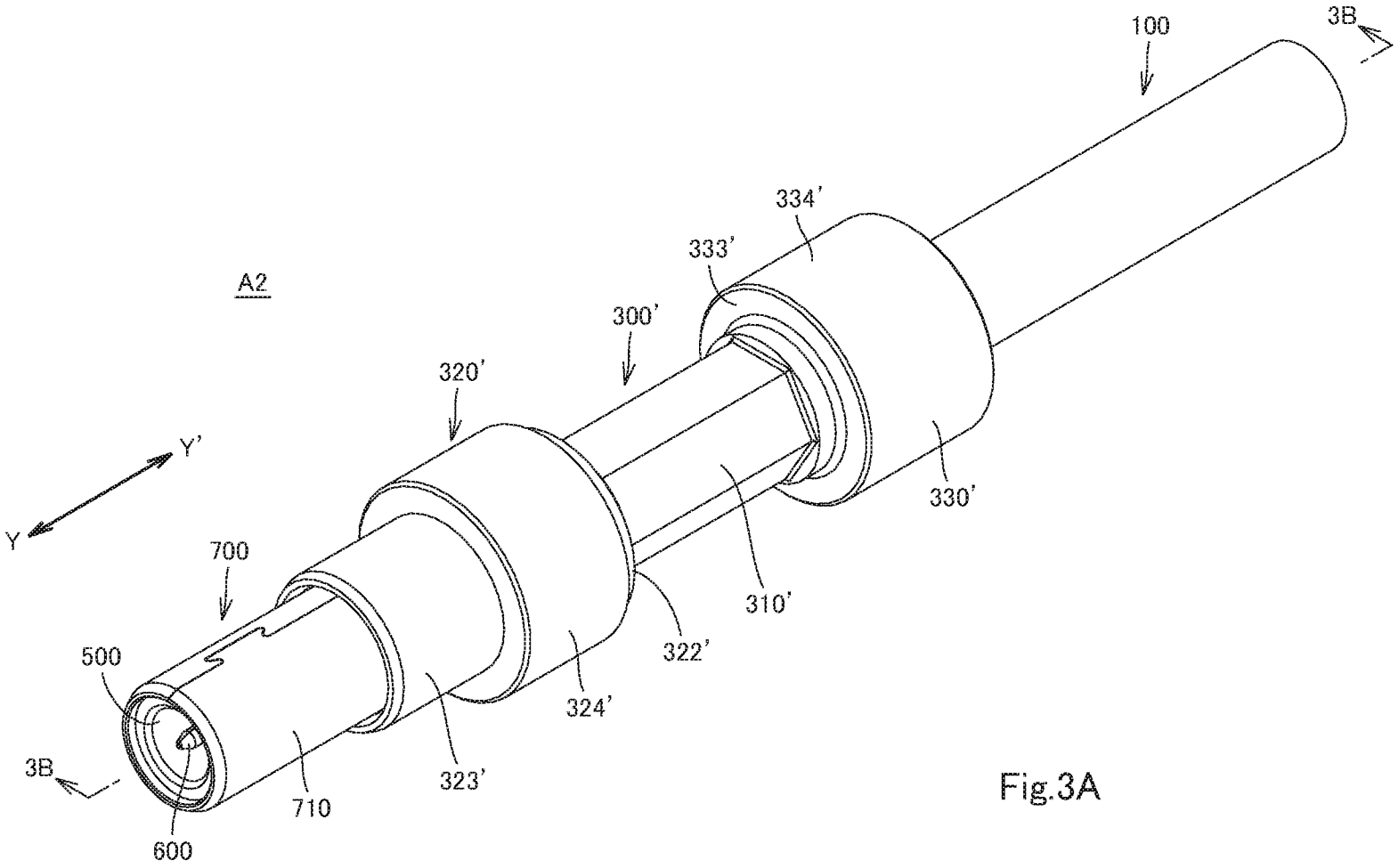
FIG. 3A is a front, top, right side perspective view of a cable assembly of a second embodiment of the invention.
Figure 3B:
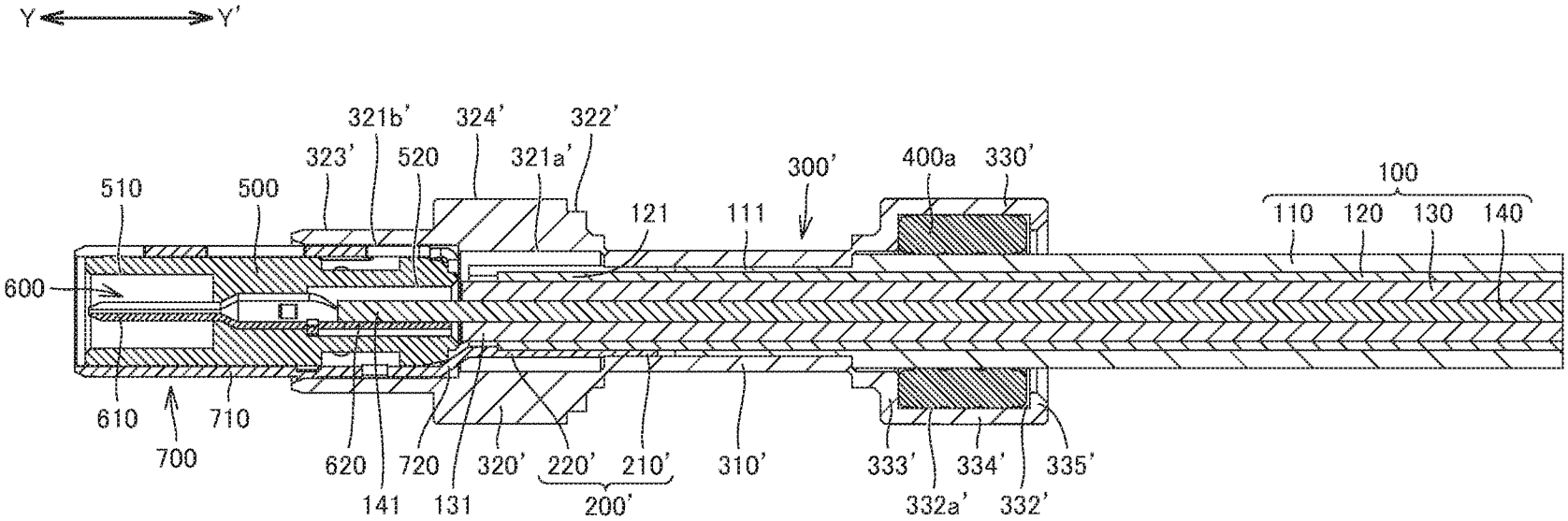
FIG. 3B is a sectional view of the cable assembly, taken along the line 3B-3B in FIG. 3A.

A cable assembly A2 (hereinafter also referred to as assembly A2) according to some other embodiments of the invention will now be described with reference to FIGS. 3A to 4B. FIGS. 3A to 4B shows an assembly A2 according to one of these embodiments (hereinafter referred to as the second embodiment). The assembly A2 includes a cable 100, a metal clamp 200', and a metal case 300' of tuboid shape. FIGS. 3A and 3B also shows the Y-Y' direction in the same manner as FIGS. 1A and 1B.

The cable 100 of assembly A2 has the same configuration as that of the cable 100 of the assembly A1. In the embodiment shown in FIG. 3A to FIG. 4B, the cable 100 is a coaxial cable. The cable 100 is provided with one inner insulator 130 and one inner conductor 140. The outer insulator 110, the outer conductor 120, and the inner insulator 130 are each of circular tuboid shape.

The clamp 200' may have the same configuration as that of the clamp 200 of assembly A1. The clamp 200' includes a first end portion 210' being an end portion on the Y'-direction side, a second portion 220' being an end portion on the Y-direction side, and a middle portion therebetween. The clamp 200' may not have any engaging protrusion 230 as in the embodiment of FIG. 3B to FIG. 4B, but may have at least one engaging protrusion 230.

Figure 4A:
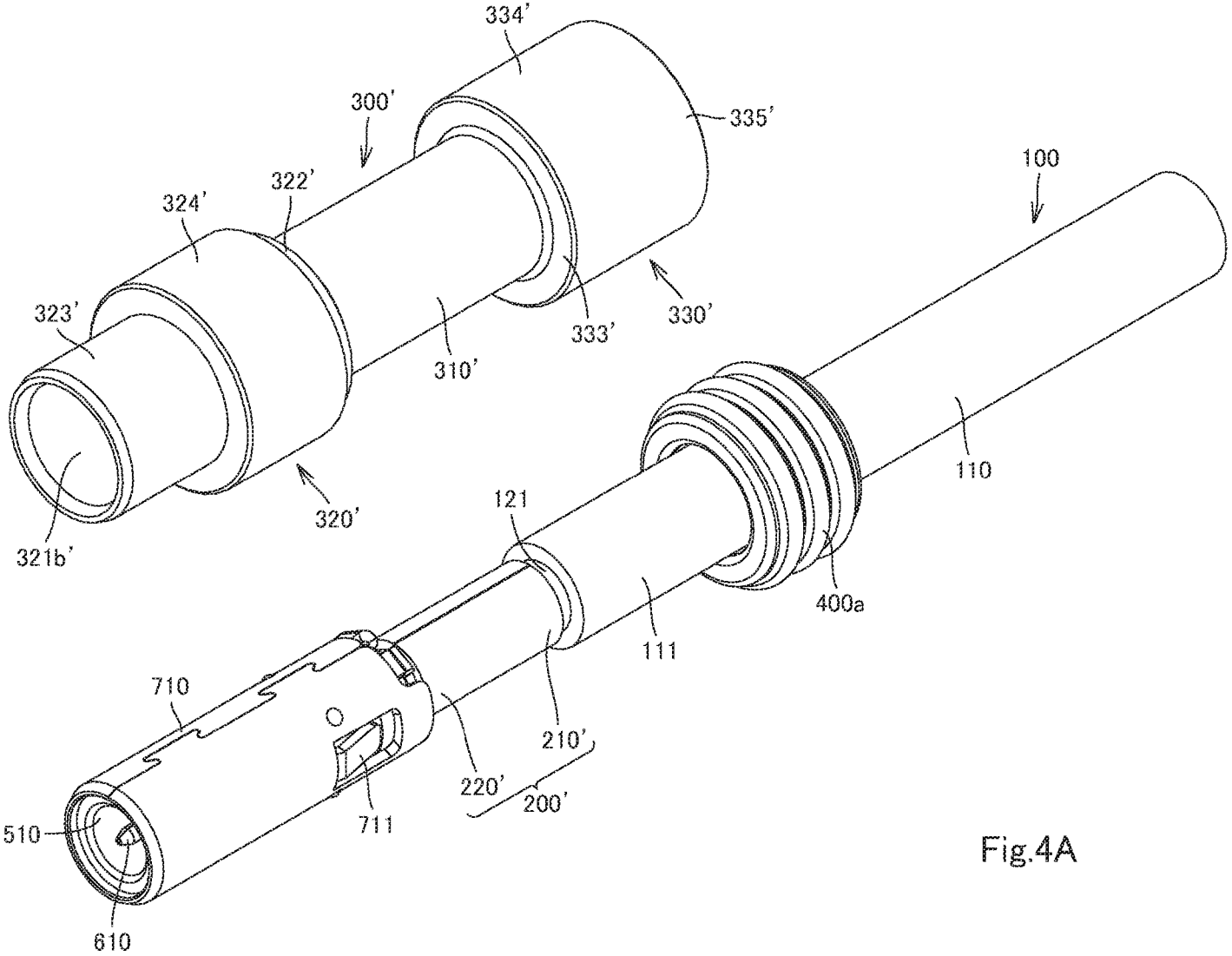
FIG. 4A is a front, top, right side perspective view of a cable, a clamp, a metal case, and a first seal of the cable assembly in a state before inserting the cable and the clamp into the metal case.
Figure 4B:
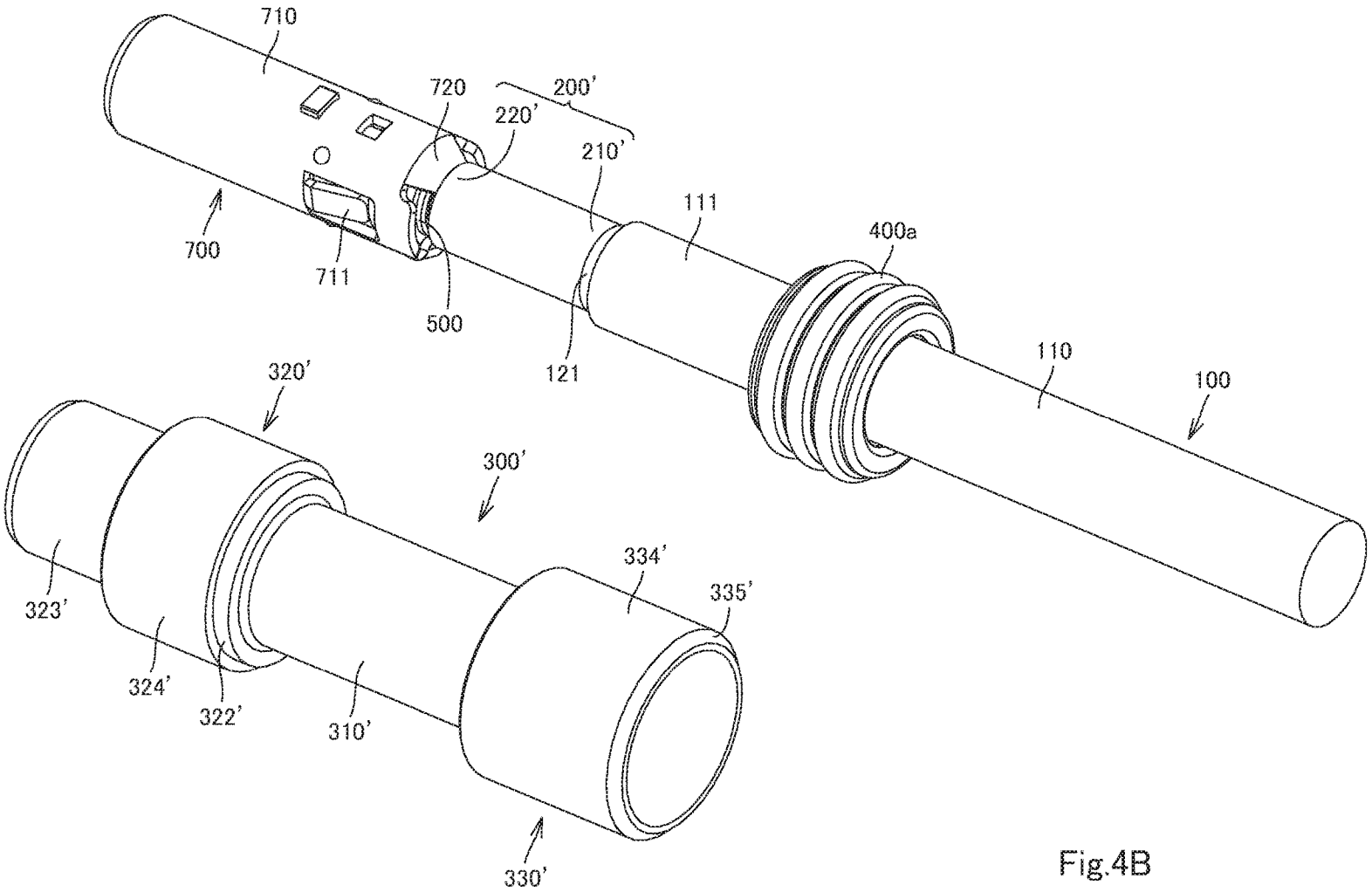
FIG. 4B is a rear, bottom, left side perspective view of the cable, the clamp, the metal case, and the first seal of the cable assembly in a state before inserting the cable and the clamp into the metal case.

The metal case 300' may or may not have the same configuration as the metal case 300 of the assembly A1. The metal case 300' includes a swaged portion 310', which may have the same configuration as the swaged portion 310 of the metal case 300. In the embodiment shown in FIG. 3B, the swaged portion 310' is in pressure contact with and fixed to the first end portion 111 of the outer insulator 110 of the cable 100 and the first end portion 210' of the clamp 200'. The pressure onto the swaged portion 310' causes elastic deformation of the first end portion 111 of the outer insulator 110 of the cable 100 and plastically deformation of the first end portion 210' of the clamp 200'. FIG. 3A and FIG. 3B illustrate the swaged portion 310' as swaged, and FIG. 4A and FIG. 4B illustrates the swaged portion 310' as unswaged. Hereinafter, the portion of the clamp 200' that is fixed to the swaged portion 310'will also referred to as a fixed portion of the clamp 200'.

The metal case 300' may include a second unswaged portion 330'. The second unswaged portion 330' may have the same configuration as the second unswaged portion 330 of the metal case 300 but may be different from the second unswaged portion 330 in the following respects. The second unswaged portion 330' may include a hole and a housing recess 332'. The hole extends in the Y-Y' direction through the second unswaged portion 330' and receives therethrough the outer insulator 110 of the cable 100. The housing recess 332' has a ring shape and communicates with the hole of the second unswaged portion 330'. The housing recess 332' has a bottom 332*a*' extending substantially in parallel to the part of the outer insulator 110 of the cable 100 located inside the second unswaged portion 330'.

The assembly A2 may further include a seal 400*a* (first seal as defined in the claims). The seal 400*a* is an annular elastic body, made of rubber or a like material, to receive therethrough the outer insulator 110 of the cable 100. The seal 400*a* is housed in the housing recess 332' of the second unswaged portion 330'. The seal 400*a* has an inner size or inner diameter that corresponds to the outer size or outer diameter of the outer insulator 110 of the cable 100. The seal 400*a* has an outer shape or outer diameter that corresponds to the shape of the housing recess 332'. The seal 400*a* is in intimate contact with a portion of the outer insulator 110 on the Y'-direction side relative to the first end portion 111 and in intimate contact with the annular inwardly-facing bottom surface 332*a*' of the housing recess 332'.

In the embodiment of FIG. 3A to FIG. 4B, the second unswaged portion 330' further includes a first wall 333' and a second wall 334'. The first wall 333' is an annular wall extending on a plane orthogonal to the Y-Y' direction. The second wall 334' is a tube extending in the Y-Y' direction from the outer circumference of the first wall 333'. The first wall 333' and the second wall 334' define the housing recess 332'. In this case, the second wall 334' has a Y'-direction end portion, i.e. the rim on the Y'-direction side of the housing recess 332'.

The second unswaged portion 330' may further include a bent portion 335'. The bent portion 335' is provided along the edge on the Y'-direction side of the housing recess 332' and is bent such as to contact the seal 400*a* from the 'Y-direction side. The inner rim of the bent portion 335' may preferably spaced from the outer insulator 110 of the cable 100 as shown in FIG. 3B. The second unswaged portion 330' and the seal 400*a* may be replaced with the second unswaged portion 330 of the assembly A1.

The metal case 300' may include a first unswaged portion 320'. The first unswaged portion 320' may have the same configuration as the first unswaged portion 320 of the metal case 300 but may be different from the first unswaged portion 320 in the following respects. The first unswaged portion 320' may have a first hole 321*a*' on the Y'-direction side and a second hole 321*b*' on the Y-direction side communicating with the first hole 321*a*'. If the fixed portion of the clamp 200' is a portion of the clamp 200', the first hole 321*a*' of the first unswaged portion 320 may house a portion of the clamp 200' on the Y-direction side relative to the fixed portion and the protruding portion 131 of the inner insulator 130 of the cable 100, or alternatively house a portion of the clamp 200' on the Y-direction side relative to the fixed portion, the protruding portion 131 of the inner insulator 130 of the cable 100, and a portion on the Y'-direction side of the connecting portion 141 of the inner conductor 140. If the fixed portion of the clamp 200' is the entire clamp 200' as described above, the first hole 321*a*' of the first unswaged portion 320 may house the protruding portion 131 of the inner insulator 130 of the cable 100, or alternatively house the protruding portion 131 of the inner insulator 130 of the cable 100 and a portion on the Y'-direction side of the connecting portion 141 of the inner conductor 140. In the embodiment of FIG. 3B, the first hole 321*a*' of the first unswaged portion 320 houses in a non-contacting manner a portion of the clamp 200' on the Y-direction side relative to the fixed portion, and the protruding portion 131 of the inner insulator 130 of the cable 100.

The assembly A2 includes a body 500, which may have the same configuration as the body of the assembly A1. The assembly A2 includes at least one terminal 600, which may have the same configuration as the terminal of the assembly A1. In the embodiment of FIG. 3B, the body includes a connecting portion 510 and a support portion 520, and a single terminal 600 is provided including a contact portion 610 and a tail 620. The contact portion 610 is a pin extending in the Y-Y' direction and disposed inside a connecting hole of the connecting portion 510. The tail 620 is disposed inside a support hole of the support portion 520 and connected to the connecting portion 141 of the inner conductor 140 of the cable 100.

The assembly A2 may further include a metal shell 700. The metal shell 700 includes a shell body 710 and a connecting portion 720. The connecting portion 720 mechanically and electrically connects between the second portion 220' of the clamp 200' and the shell body 710. The connecting portion 720 may be disposed inside the first unswaged portion 320'. In the embodiment of FIG. 3B, the connecting portion 720 is disposed inside the first hole 321*a*' of the first unswaged portion 320'. If the first unswaged portion 320' is omitted, the connecting portion 720 may preferably be disposed on the Y'-direction side of the metal shell 700.

The shell body 710 is a tuboid or box-shaped portion to hold the body 500 and house the body 500, the at least one terminal 600, and the connecting portion 141 of the inner conductor 140 of the cable 100. The shell body 710 opens in the Y direction to expose the connecting portion 510 of the body 500 and the contact portion 610 of the terminal 600. The shell body 710 may or may not have at least two holding pieces 711 to elastically hold the body 500 from opposite sides.

The shell body 710 may have a portion housed in the second hole 321*b*' of the first unswaged portion 320'. In this case, the second hole 321*b*' of the first unswaged portion 320' may have a size or diameter that is larger than the outer size or outer diameter of the housed portion of the shell body 710. Alternatively, as shown in FIG. 3A to FIG. 4B, the second hole 321*b*' may have a size or diameter corresponding to the outer size or outer diameter of the housed portion of the shell body 710. In this case, a portion on the Y'-direction side of the shell body 710 is housed and held inside the second hole 321*b*' of the first unswaged portion 320'.

Alternatively, the shell body 710 may be disposed on the Y-direction side relative to the metal case 300'. In this case, the body 500, at least one terminal 600, and the connecting portion 141 of the inner conductor 140 of the cable 100 as housed in the shell body 710 are also disposed on the Y-direction side relative to the metal case 300'. Also in this case, the first unswaged portion 320' of the metal case 300' may be omitted.

The assembly A2 as shown in FIG. 3A to FIG. 4B may be manufactured in the following steps. First, the body 500 is prepared as holding the terminal 600. The terminal 600 may be insert-molded in the body 500 or may be inserted and held in the holding hole of the body 500. The cable 100 is prepared in the same manner as the cable 100 of the assembly A1. The connecting portion 141 of the inner conductor 140 of the cable 100 is connected to the tail 620 of the terminal 600 by soldering or with conductive adhesive.

Then, a sheet metal is prepared as including a first end portion corresponding to the clamp 200' in an expanded state, a second portion corresponding to the shell body 710 in an expanded state, and the connecting portion 720. The first end portion of the sheet metal is wrapped around the protruding portion 121 of the outer conductor 120 of the cable 100 to be curved into tubular shape or a shape having a cross-section generally of arcuate shape, C-shape, or U-shape. The first end portion thus becomes the clamp 200' fitting around the protruding portion 121. On the other hand, the second portion of the sheet metal is bent or curved into a tubular or box shape such as to surround the body 500, the terminal 600, and the connecting portion 141 of the inner conductor 140. The formed second portion becomes the shell body 710 housing the body 500, the terminal 600, and the connecting portion 141 of the inner conductor 140.

The metal case 300' is also prepared having the following configurations (1) to (3):

(1) The first unswaged portion 320' and the second unswaged portion 330' are formed in advance, while the middle portion of the metal case 300' is het to be swaged;

(2) The inner size or inner diameter of the metal case 300' is larger in its entirety than the outer shape or outer diameter of the cable 100 and that of the clamp 200' as fitting around the protruding portion 121 of the outer conductor 120 of the cable 100; and (3) The bent portion 335' of the second unswaged portion 330' of the metal case 300' extends in the Y' direction.

Inserted into the metal case 300' from the Y-direction side are the cable 100, the clamp 200', the metal shell 700, the body 500, and the terminal 600. This insertion step includes disposing at least the first end portion 210 of the clamp 200', as fitting around the protruding portion 121 of the outer conductor 120, and the first end portion 111 of the outer insulator 110 inside the middle portion of the metal case 300'; disposing at least the protruding portion 131 of the inner insulator 130 and the connecting portion 720 of the metal shell 700 inside the first hole 321*a*' of the first unswaged portion 320' of the metal case 300', and housing and holding a portion on the Y'-direction side of the metal shell 700 inside the second hole 321*b*' of the first unswaged portion 320' of the metal case 300'.

The seal 400*a* is also prepared. The cable 100 is inserted into the seal 400*a*, and the seal 400*a* is disposed on a portion of the cable 100 on the Y'-direction side relative to the first end portion 111 of the outer insulator 110 so as to be housed in the housing recess 332' of the second unswaged portion 330' of the metal case 300'. The seal 400*a* is thus brought into intimate contact with the outer insulator 110 of the cable 100 and with the bottom 332*a*' of the housing recess 332' of the second unswaged portion 330'. The part corresponding to the bent portion 335' of the second unswaged portion 330' is bent to be brought into abutment with the seal 400*a* from the Y'-direction side.

Thereafter, the middle portion of the metal case 300' is swaged from the outside. The swaging step of the metal case 300 includes bringing the middle portion of the metal case 300' into pressure contact with at least the first end portion 111 of the outer insulator 110 of the cable 100 and the first end portion 210' of the clamp 200' so as to fix the middle portion to at least the first end portion 111 of the outer insulator 110 of the cable 100 and the first end portion 210' of the clamp 200'. The swaged middle portion of the metal case 300' becomes the swaged portion 310'. The pressing of the metal case 300' at least causes at least elastic deformation of the first end portion 111 of the outer insulator 110 and plastic deformation of the first end portion 210' of the clamp 200'.

If the assembly A2 does not include the seal 400*a* and the second unswaged portion 330' does not include the housing recess 332' or the bent portion 335', then the assembly A2 is manufactured without the above mounting step of the seal 400*a* and the above bending step of the bent portion 335'. In a variant of the assembly A1 in which the second unswaged portion 330 is replaced with the seal 400*a* and the second unswaged portion 330' of the assembly A2, the assembly A1 can be manufactured by adding the above mounting step of the seal 400*a* and the above bending step of the bent portion 335'. In this case, the mounting step of the seal 400*a* and the bending step of the bent portion 335' may be performed before inserting the cable 100 and the clamp 200 into the metal case 300.

The assembly A2 has the first to third technical features of the assembly A1. Further, as a fourth technical feature, the outer insulator 110 of the cable 100 is relatively unlikely to be subjected to load caused when the cable 100 is bent at a portion on the Y'-direction side of the metal case 300. This is because, in an embodiment where the second unswaged portion 330' of the metal case 300' has the bent portion 335', the inner rim of the bent portion 335' is spaced from the outer insulator 110 of the cable 100. This configuration reduces the possibility that the cable contacts the second unswaged portion 330' of the metal case 300' even when the cable 100 is bent at a portion on the Y'-direction side of the metal case 300. Such reduced contacts can reduce load on the outer insulator 110 of the cable 100.

Fifth, the assembly A2 has improved resistance to water and dust. This is because the seal 400*a* is in intimate contact with the outer insulator 110 of the cable 100 and the bottom 332*a*' of the housing recess 332' of the second unswaged portion 330' of the metal case 300'. This configuration prevents or reduces entry of liquid, dusts, and other foreign matter into the metal case 300' from the Y'-direction side.

Figure 5A:
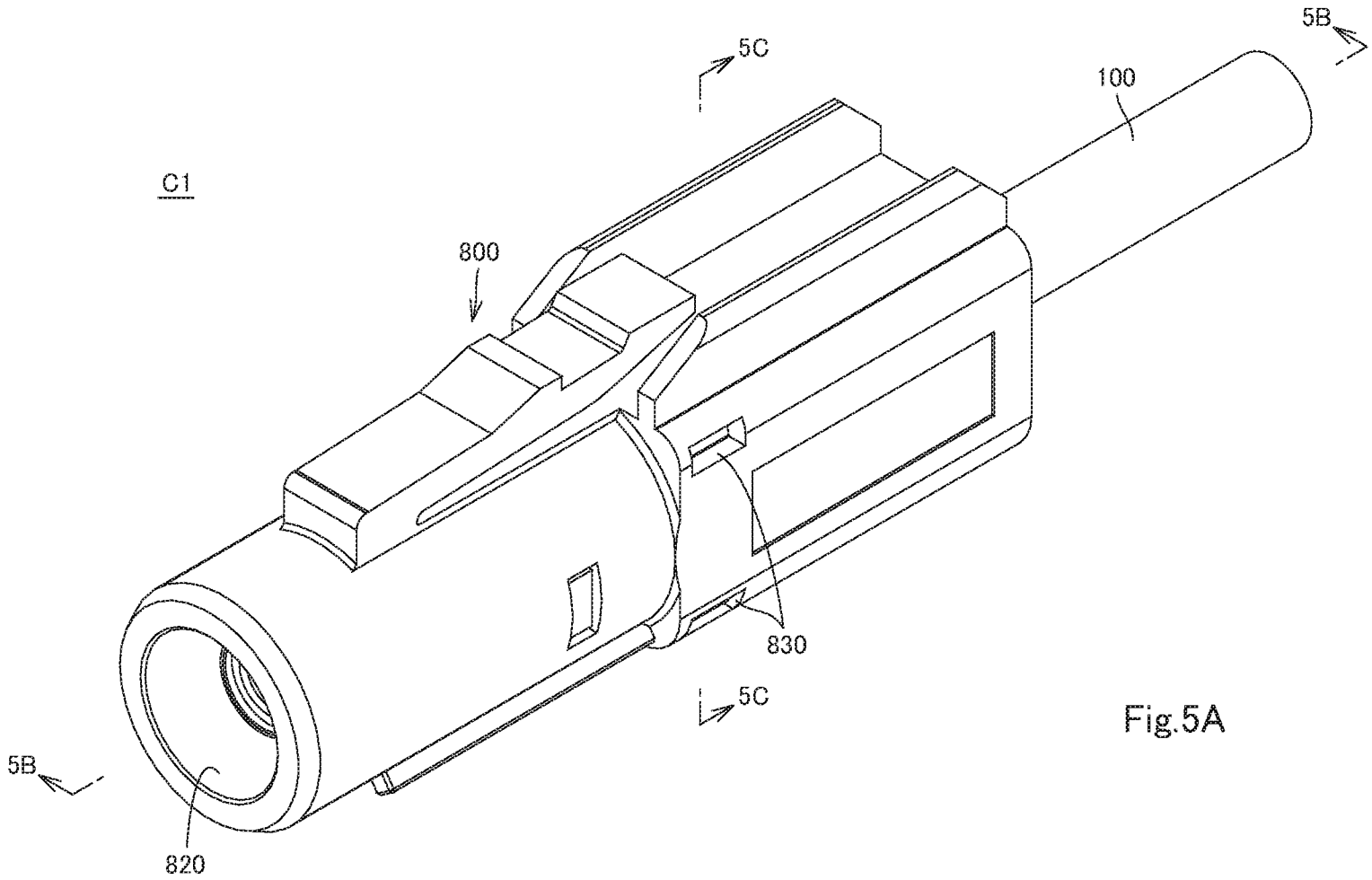
FIG. 5A is a front, top, right side perspective view of a connector including the cable assembly of the second embodiment of the invention.
Figure 5B:
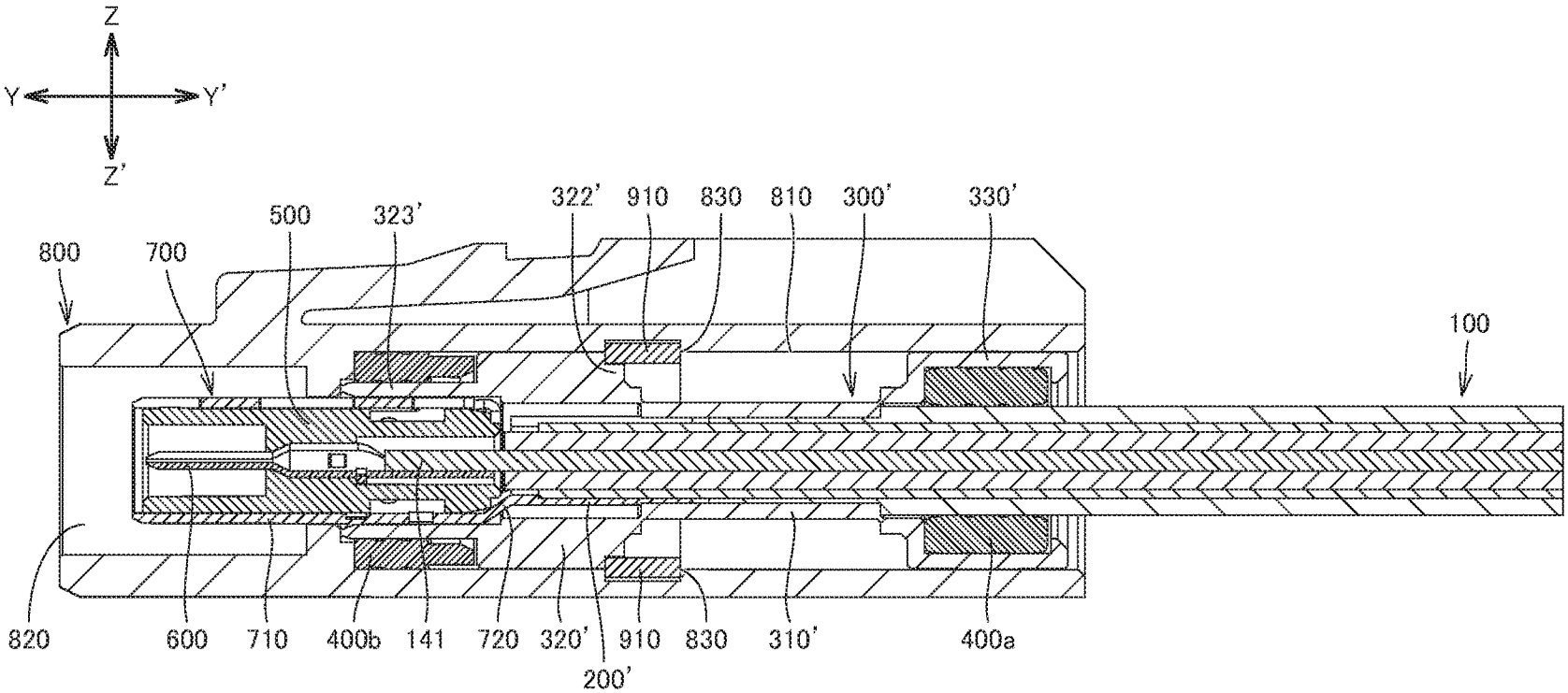
FIG. 5B is a sectional view of the connector, taken along the line 5B-5B in FIG. 5A.
Figure 5C:
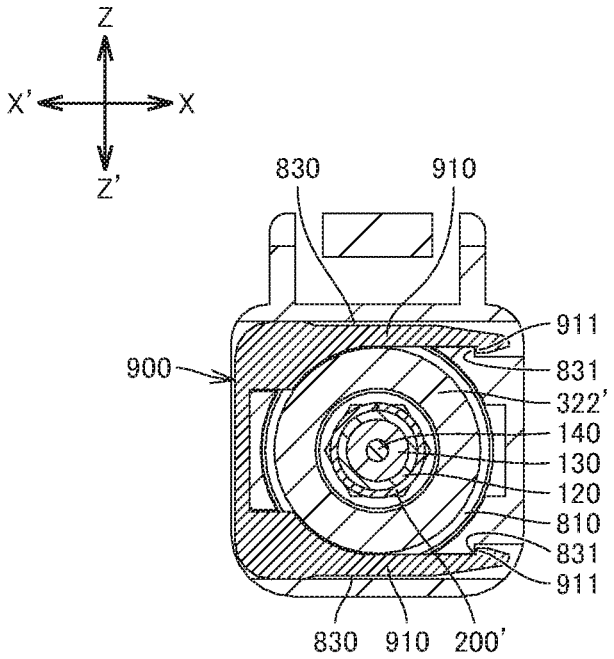
FIG. 5C is a sectional view of the connector, taken along the line 5C-5C in FIG. 5A.
Figure 5D:
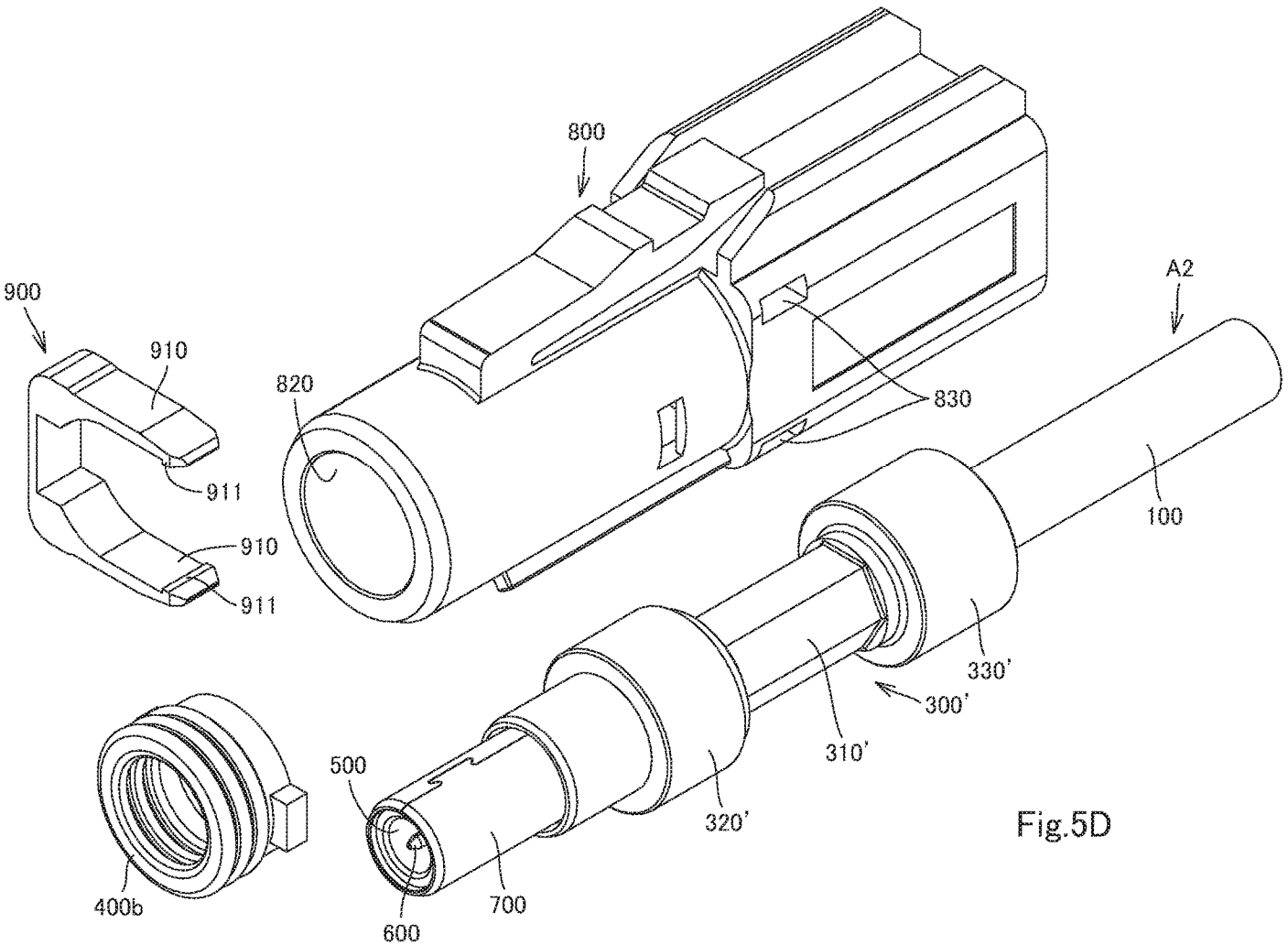
FIG. 5D is an exploded perspective view of the connector.

A connector C1 including the assembly A2 will be described below with reference to FIG. 5A to FIG. 5D. FIG. 5B indicates the Y-Y' direction. FIGS. 5B and 5C indicates the Z-Z' direction, which corresponds to the second direction in the claims. The Z-Z' direction is orthogonal to the Y-Y' direction. FIG. 5C indicates the X-X' direction, which is orthogonal to the Y-Y' and Z-Z' directions.

The connector C1 includes the assembly A2 and a resin case 800. The resin case 800 has a housing hole 810 opening in the Y' direction. The housing hole 810 houses the assembly A2 at least partially from the Y'-direction side. In the embodiment of FIG. 5B, the housing hole 810 is provided in a portion on the Y'-direction side of the resin case 800 and has a size or diameter corresponding to each outer size or outer diameter of the first unswaged portion 320' and the second unswaged portion 330' of the metal case 300' of the assembly A2. The metal case 300' fits in the housing hole 810 from the Y'-direction side.

The resin case 800 may further include a connecting hole 820. The connecting hole 820 is located on the Y-direction side relative to and communicates with the housing hole 810 of the resin case 800. The connecting hole 820 opens in the Y direction. The connecting hole 820 can fittingly receive a mating connector to be connected to the connector C1. Disposed inside the connecting hole 820 are a portion on the Y-direction side of the shell body 710 of the metal shell 700, a portion on the Y-direction side of the body 500, and the contact portion 610 of the terminal 600 of the assembly A2. The contact portion 610 of the terminal 600 is connectable to a terminal of a mating connector.

As shown in FIG. 5B and FIG. 5C, the resin case 800 may further include a pair of communicating holes 830, namely a Z-direction side communicating hole 830 and a Z'-direction side communicating hole 830. The communicating holes 830 open at least in the X' direction. The Z-direction side communicating hole 830 extends in the X-X' direction on the Z direction side relative to, and communicates with, the housing hole 810 of the resin case 800. The Z'-direction side communicating hole 830 extends in the X-X' direction on the Z' direction side relative to, and communicates with, the housing hole 810 of the resin case 800.

The connector C1 may further include a holding portion 900 fixed to the resin case 800. The holding portion 900 is generally U-shaped and includes a pair of holding arms 910 extending in the X-X' direction, namely a Z-direction side holding arms 910 and a Z'-direction side holding arms 910. The Z-direction side holding arms 910 is disposed inside the Z-direction side communicating hole 830 to be in elastic contact from the Z-direction side with the first unswaged portion 320' of the metal case 300' inside the housing hole 810. The Z'-direction side holding arms 910 is disposed inside the Z'-direction side communicating hole 830 to be in elastic contact from the Z'-direction side with the first unswaged portion 320' of the metal case 300' inside the housing hole 810. The pair of holding arms 910 thus holds the first unswaged portion 320' securely, so that the assembly A2 is securely positioned inside the resin case 800. The first unswaged portion 320' may further include a holdable portion 322' to be securely held by the holding arms 910.

The Z-direction side communicating hole 830 may be provided with an engaging protrusion 831 on its wall on the Z'-direction side, and the Z-direction side holding arm 910 may have a lug 911 in engagement with the engaging protrusion 831. The Z'-direction side communicating hole 830 may be provided with an engaging protrusion 831 on its wall on the Z-direction side, and the Z'-direction side holding arm 910 may have a lug 911 in engagement with the engaging protrusion 831 of the Z'-direction side communicating hole 830.

The connector C1 may further include a seal 400*b*, which corresponds to the second seal in the claims. The seal 400*b* is an annular elastic body. The seal 400*b* may receive therein, or therethrough, at least one of the first unswaged portion 320' and the second unswaged portion 330' of the metal case 300' of the assembly A2. The seal 400*b* may preferably be in intimate contact with at least one of these unswaged portions and the wall of the housing hole 810 of the resin case 800. The wall of the housing hole 810 extends substantially in parallel to the outer face of the inserted unswaged portion. The unswaged portion to be inserted may include an insertable portion to be received in the seal 400*b* such as to be in intimate contact with the seal 400*b*. In the embodiment of FIG. 5B, the first unswaged portion 320' includes an insertable portion 323', which extends through the seal 400*b* such that the seal 400*b* is interposed in a compressed state between the insertable portion 323' and the wall of the housing hole 810.

The first unswaged portion 320' may further include a larger-diameter portion 324'. The outer size or outer diameter of the larger-diameter portion 324' may correspond to the size or diameter of the housing hole 810 of the resin case 800. The larger-diameter portion 324' may be fittingly received in the housing hole 810. In the embodiment of FIG. 3A to FIG. 5D, the insertable portion 323' is the Y-direction end portion of the first unswaged portion 320', the holdable portion 322' is the Y'-direction end portion of the first unswaged portion 320', and the larger-diameter portion 324' is a portion therebetween. In other embodiments, the insertable portion 323', the holdable portion 322', and the larger-diameter portion 324' may be any portions of the first unswaged portion 320'.

The connector C1 as illustrated in FIG. 5A to FIG. 5D may be manufactured in the following steps. First, the assembly A2 and the seal 400*b* are prepared. The insertable portion 323' of the first unswaged portion 320' of the assembly A2 is inserted into and through the seal 400*b*. This brings the insertable portion 323' into intimate contact with the seal 400*b*.

The resin case 800 is also prepared. The assembly A2 and the seal 400*b* are inserted into the housing hole 810 of the resin case 800 from the Y'-direction side. Then, the metal case 300' of the assembly A2 fits in the housing hole 810, and the Y-direction end portion of the shell body 710 of the metal shell 700, the Y-direction end portion of the body 500, and the contact portion 610 of the terminal 600 of the assembly A2 are disposed inside the connecting hole 820 through the housing hole 810. Upon this insertion, the seal 400*b* is brought into intimate contact with the wall of the housing hole 810 and interposed in a compressed state between the insertable portion 323' and the wall of the housing hole 810. Thereafter, the pair of holding arms 910 of the holding portion 900 are respectively inserted into the pair of communicating holes 830 of the resin case 800. The holding arms 910 thus securely hold the first unswaged portion 320' of the metal case 300' in the Z-Z' direction inside the housing hole 810. The connector C1 is thus assembled.

The connector C1 has the same technical features as the assembly A2. Moreover, the connector C1 has improved resistance to water and dust. This is because the seal 400*b* is interposed in a compressed state between at least one of the first unswaged portion 320' and the second unswaged portion 330' and the wall of the housing hole 810 of the resin case 800.

The cable assembly, the connector, and the method for manufacturing the cable assembly of the invention are not limited to the embodiments described above but may be modified in any manner within the scope of the claims. Specific modifications will be described below.

In the metal case of the invention, the first unswaged portion and/or the second unswaged portion may be omitted. The body and the terminal may be omitted in the invention. The metal shell may be omitted in the invention. The seal 400*a* and/or 400*b* may be omitted. The connector of the invention may include any resin case configured to house the assembly of any aspect described above. In the connector of the invention, the holding portion may be omitted. When the holding portion is omitted, the communicating holes of the resin case should also be omitted.

It should be appreciated that the above embodiments and variants of the cable assembly and the connector are described above by way of examples only. The materials, shapes, dimensions, numbers, arrangements, and other configurations of the constituents of the cable assembly and the connector may be modified in any manner if they can perform similar functions. The configurations of the embodiments and the variants described above may be combined in any possible manner. The first direction of the invention may be any direction if it is the longitudinal direction of the metal case. The second direction of the invention may be any direction orthogonal to the first direction.

REFERENCE SIGNS LIST

- A1: Cable assembly
  - 100: Cable
    - 110: Outer insulator
      - 111: First end portion
    - 120: Outer conductor
      - 121: Protruding portion
    - 130: Inner insulator
      - 131: Protruding portion
    - 140: Inner conductor
      - 141: Connecting portion
  - 200: Clamp
    - 210: First end portion
    - 220: Second portion
    - 230: Engaging protrusion
  - 300: Metal case
    - 310: Swaged portion
    - 320: First unswaged portion
    - 330: Second unswaged portion
      - 331: chamfer
- C1: Connector
- A2: Cable assembly
  - 100: Cable
    - 110: Outer insulator
      - 111: First end portion
    - 120: Outer conductor
      - 121: Protruding portion
    - 130: Inner insulator
      - 131: Protruding portion
    - 140: Inner conductor
      - 141: Connecting portion
  - 200': Clamp
    - 210': First end portion
    - 220': Second portion
  - 300': Metal case
    - 310': Swaged portion
    - 320': First unswaged portion
      - 321*a*': First hole
      - 321*b*': Second hole
      - 322': Holdable portion
      - 323': Insertable portion
      - 324': Larger-diameter portion
    - 330': Second unswaged portion
      - 332': Housing recess
        - 332*a*': Bottom
      - 333': First wall
      - 334': Second wall
      - 335': Bent portion
  - 400*a*: Seal (first seal)
  - 500: Body
    - 510: Connecting portion
    - 520: Support portion
  - 600: Terminal
    - 610: Contact portion
    - 620: Tail
  - 700: Metal shell
    - 710: Shell body
    - 720: Connecting portion
  - 800: Resin case
    - 810: Housing hole
    - 820: Connecting hole
    - 830: Communicating hole
      - 831: Engaging protrusion

900: Holding portion
910: Holding arm
911: Lug
400*b*: Seal (second seal)

The invention claimed is:

1. A cable assembly comprising:

a cable extending in a first direction, the first direction including one and the other sides, the cable including:

an outer insulator of tuboid shape, having a first end portion on the one side in the first direction, and an outer conductor of tuboid shape disposed inside the outer insulator, the outer conductor including a protruding portion protruding from the first end portion of the outer insulator to the one side in the first direction;

a clamp made of metal, securely holding the protruding portion of the outer conductor and including a first end portion, the first end portion of the clamp being an end portion of the clamp that is on the other side in the first direction and located on the one side in the first direction relative to the first end portion of the outer insulator; and a metal case of tuboid shape, including a swaged portion of tuboid shape housing at least the first end portion of the outer insulator and the first end portion of the clamp, wherein the swaged portion is swaged from outside of the swaged portion such as to be in pressure contact with and fixed to at least the first end portion of the outer insulator and the first end portion of the clamp so that the first end portion of the outer insulator is elastically deformed and the first end portion of the clamp is plastically deformed.

2. The cable assembly according to claim 1, wherein the metal case further includes a first unswaged portion, the first unswaged portion being a tuboid end portion on the one side in the first direction of the metal case, the cable further includes:

at least one inner insulator of tubular shape, and at least one inner conductor, the inner insulator is disposed inside the outer conductor and includes a protruding portion protruding from the protruding portion of the outer conductor to the one side in the first direction, and the inner conductor is disposed inside the inner insulator and includes a connecting portion, the connecting portion protruding from the protruding portion of the inner insulator to the one side in the first direction, and the first unswaged portion houses the protruding portion of the inner insulator and the connecting portion of the inner conductor.

3. The cable assembly according to claim 1, wherein the clamp comprises a sheet metal wrapped around the protruding portion of the outer conductor.

4. The cable assembly according to claim 1, wherein the metal case further includes:

a first unswaged portion being a tuboid end portion on the one side in the first direction of the metal case; and a second unswaged portion being a tuboid end portion on the other side in the first direction of the metal case, the second unswaged portion being larger in inner size or inner diameter than the swaged portion, the swaged portion is located between the first unswaged portion and the second unswaged portion of the metal case, and the outer insulator of the cable extends through the second unswaged portion with a clearance therebetween.

5. The cable assembly according to claim 4, wherein the second unswaged portion includes:

an inner rim on the other side in the first direction of the second unswaged portion; and a chamfer along the inner rim.

6. The cable assembly according to claim 4, wherein the clamp comprises a sheet metal wrapped around the protruding portion of the outer conductor.

7. A connector comprising:

the cable assembly according to claim 4;

a resin case; and a holding portion generally of U-shape, wherein the resin case has:

a housing hole configured to house the cable assembly, and a pair of communicating holes communicating with the housing hole on one and the other sides, respectively, in a second direction of the housing hole, the second direction being orthogonal to the first direction, the holding portion is fixed to the resin case and has a pair of holding arms, and the holding arms are disposed inside the associated communicating holes and securely hold the first unswaged portion of the metal case.

8. A connector comprising:

the cable assembly according to claim 4;

a resin case having a housing hole configured to house the cable assembly; and a second seal being an annular elastic body, wherein at least one of the first unswaged portion and the second unswaged portion of the metal case of the cable assembly extend inside the second seal, and the second seal is in intimate contact with the at least one unswaged portion and a wall of the housing hole of the resin case.

9. The cable assembly according to claim 4, wherein the second unswaged portion includes a housing recess of ring shape, the housing recess communicating with a hole of the second unswaged portion and having a bottom, the cable assembly further comprises a first seal being an annular elastic body housed in the housing recess, the outer insulator of the cable extends through the first seal, and the first seal is in intimate contact with the outer insulator and the bottom of the housing recess.

10. The cable assembly according to claim 9, wherein the second unswaged portion further includes a bent portion along an edge on the other side in the first direction of the housing recess, the bent portion being bent such as to be in contact with the first seal from the other side in the first direction.

11. The cable assembly according to claim 1, further comprising:

a body having an insulating property; and a terminal held by the body, wherein the cable further includes:

at least one inner insulator of tubular shape; and at least one inner conductor, the inner insulator is disposed inside the outer conductor and includes a protruding portion protruding from the protruding portion of the outer conductor to the one side in the first direction, and the inner conductor is disposed inside the inner insulator and includes a connecting portion, the connecting portion protruding from the protruding portion of the inner insulator to the one side in the first direction and being connected to the terminal.

12. The cable assembly according to claim 11, further comprising a metal shell connected to the clamp, wherein the metal shell houses the body, the terminal, and the connecting portion of the inner conductor.

13. The cable assembly according to claim 1, further comprising:

a body having an insulating property; and a terminal held by the body; and a metal shell connected to the clamp, wherein the cable further includes:

at least one inner insulator of tubular shape, and at least one inner conductor, the inner insulator is disposed inside the outer conductor and includes a protruding portion protruding from the protruding portion of the outer conductor to the one side in the first direction, and the inner conductor is disposed inside the inner insulator and includes a connecting portion, the connecting portion protruding from the protruding portion of the inner insulator to the one side in the first direction and being connected to the terminal, the metal case further includes a first unswaged portion, the first unswaged portion being a tuboid end portion on the one side in the first direction of the metal case, the metal shell houses the body, the terminal, and the connecting portion of the inner conductor, and the first unswaged portion of the metal case houses a portion on the other side in the first direction of the metal shell.

14. The cable assembly according to claim 13, wherein the first unswaged portion of the metal case houses and holds said portion on the other side in the first direction of the metal shell.

15. A connector comprising:

the cable assembly according to claim 13;

a resin case; and a holding portion generally of U-shape, wherein the resin case has:

a housing hole configured to house the cable assembly, and a pair of communicating holes communicating with the housing hole on one and the other sides, respectively, in a second direction of the housing hole, the second direction being orthogonal to the first direction, the holding portion is fixed to the resin case and has a pair of holding arms, and the holding arms are disposed inside the associated communicating holes and securely hold the first unswaged portion of the metal case.

16. The cable assembly according to claim 4, further comprising:

a body having an insulating property; and a terminal held by the body; and a metal shell connected to the clamp, wherein the cable further includes:

at least one inner insulator of tubular shape, and at least one inner conductor, the inner insulator is disposed inside the outer conductor and includes a protruding portion protruding from the protruding portion of the outer conductor to the one side in the first direction, and the inner conductor is disposed inside the inner insulator and includes a connecting portion, the connecting portion protruding from the protruding portion of the inner insulator to the one side in the first direction and being connected to the terminal, the metal shell houses the body, the terminal, and the connecting portion of the inner conductor, and the first unswaged portion of the metal case houses a portion on the other side in the first direction of the metal shell.

17. The cable assembly according to claim 16, wherein the first unswaged portion of the metal case houses and holds said portion on the other side in the first direction of the metal shell.

18. The cable assembly according to claim 1, wherein the metal case further includes a first unswaged portion, the first unswaged portion being a tuboid end portion on the one side in the first direction of the metal case, the clamp includes:

a fixed portion fixed to the swaged portion of the metal case, the fixed portion comprising the first end portion of the clamp, and a portion on the one side in the first direction relative to the fixed portion, the cable further includes:

at least one inner insulator of tubular shape, and at least one inner conductor, the inner insulator is disposed inside the outer conductor and includes a protruding portion protruding from the protruding portion of the outer conductor to the one side in the first direction, and the inner conductor is disposed inside the inner insulator and includes a connecting portion, the connecting portion protruding from the protruding portion of the inner insulator to the one side in the first direction, and the first unswaged portion houses the portion of the clamp on the one side in the first direction relative to the fixed portion, the protruding portion of the inner insulator, and the connecting portion of the inner conductor.

19. A connector comprising:

the cable assembly according to claim 18;

a resin case; and a holding portion generally of U-shape, wherein the resin case has:

a housing hole configured to house the cable assembly, and a pair of communicating holes communicating with the housing hole on one and the other sides, respectively, in a second direction of the housing hole, the second direction being orthogonal to the first direction, the holding portion is fixed to the resin case and has a pair of holding arms, and the holding arms are disposed inside the associated communicating holes and securely hold the first unswaged portion of the metal case.

20. A method for manufacturing a cable assembly, the method comprising:

preparing a cable including an outer insulator and an outer conductor, the outer conductor including a protruding portion protruding to one side in a first direction from a first end portion of the outer insulator;

preparing a clamp made of metal;

fitting the clamp over the protruding portion of the outer conductor;

preparing a metal case of tubular shape;

inserting into the metal case at least the clamp, which fits over the protruding portion of the outer conductor of the cable, and the first end portion of the outer insulator of the cable; and swaging at least a portion of the metal case from outside; wherein the swaging of the metal case includes bringing the at least a portion of the metal case into pressure contact with at least the first end portion of the outer insulator and a first end portion of the clamp on the other side in the first direction so that the at least a portion is fixed to the first end portion of the outer insulator and the first end portion of the clamp, and the bringing of the metal case into pressure contact at least causes the first end portion of the outer insulator to deform elastically and the first end portion of the clamp to deform plastically.

* * * * *